United States Patent [19]

Shaffer et al.

[11] 4,166,342

[45] Sep. 4, 1979

[54] TOROIDAL POLISHER

[75] Inventors: Joseph J. Shaffer, Ridgecrest; John D. Butler, China Lake, both of Calif.

[73] Assignee: The United States of America as represented by the Secretary of the Navy, Washington, D.C.

[21] Appl. No.: 853,777

[22] Filed: Nov. 21, 1977

[51] Int. Cl.[2] ..... B24B 7/02

[52] U.S. Cl. ..... 51/58; 51/65

[58] Field of Search ..... 51/58, 7, 124 L, 64, 51/65

[56] References Cited

U.S. PATENT DOCUMENTS

| | | | |
|---|---|---|---|
| 974,880 | 11/1910 | Hammett | 51/64 |
| 2,020,312 | 11/1935 | Holman | 51/58 |
| 2,278,314 | 3/1942 | Houchin | 51/124 L |
| 3,782,042 | 1/1974 | Strasbaugh | 51/58 |
| 3,875,702 | 4/1975 | Yacos | 51/58 |

*Primary Examiner*—Harold D. Whitehead

*Attorney, Agent, or Firm*—R. S. Sciascia; W. Thom Skeer; K. G. Pritchard

[57] ABSTRACT

A machine with separate motion on two axes for toroidal polishing and grinding of mirrors. The axes are at 90° to each other and the amplitude of motion in each direction is independently adjustable. A portion of this machine can be modified to serve as an adapter unit that fits on standard polishing machines and can be removed leaving the standard machines able to function in the normal way. A gimbal assembly and stablizer bar are used to prevent twisting between a lens and a polishing surface.

18 Claims, 3 Drawing Figures

TOROIDAL POLISHER

BACKGROUND OF THE INVENTION

1. Field of the Invention

This invention pertains to lens polishing machines. It also concerns grinding lenses and mirrors. In particularity, it concerns toroidal lens polishers.

2. Description of the Prior Art

Toroidal mirrors are mirrors that have two different radii of curvature which are perpendicular to one another. These radii can be either both concave, both convex or one of each. Satisfactory long focal length toroidal mirrors have not been commercially made previously. Toroidal mirrors have been found to be more efficient in the amount of energy extracted from laser cavities than the spherical mirrors that have been used in the past. Toroidal mirrors also have the ability to form sharp images for large angles of incidence. Spherical mirrors develop excessive astigmatism under similar conditions.

In the past, toroidal and cylindrical optics were fabricated by hand or on special machines. Polishing by hand is a very slow method and the number of man hours involved can easily make the cost prohibitive. Previous toroidal machines could only be used for that one purpose. Some of these previous machines also have a significant design defect in that the movement arm has a relatively short pivot length which produces a noticable arc in its stroke.

The quality of previously produced toroidal optics has been very poor. Polishing by hand does not permit uniform repetition of motion in the polishing stroke. The previous toroidal machines produced did not have two true linear axes perpendicular to one another. Lastly, the wobble between the lens and the polishing surface, usually called the lap, produces another source of distortion.

Previously no adapter units for converting regular polishing machines into toroidal ones were known.

SUMMARY OF THE INVENTION

The present invention provides for independent motion on each of two orthogonal axes for polishing or grinding of lenses and mirrors. The lens to be polished and the lap are kept at a fixed orientation to eliminate any twisting that might occur. The combination of these factors for a lens provides two different radii of curvature which are orthogonal.

Independent motion on the first axis is provided by using a motor and a cylindrical cam to convert rotary motion into reciprocating rectilinear motion. The range of this motion can be varied by a variable adjustment screw. The independent motion along the second axis is provided by a second motor driving a spindle arm holding either the lap or the lens. This spindle correspondes to the upper spindle in a conventional polishing machine.

The gimbal assembly is used to hold either the lens or lap. This permits tilting of the gimbal assembly to keep the lens and lap in contact. A stabilizer rod is attached to the gimbal assembly to prevent it from twisting.

DESCRIPTION OF THE PREFERRED EMBODIMENTS

Figure 1:
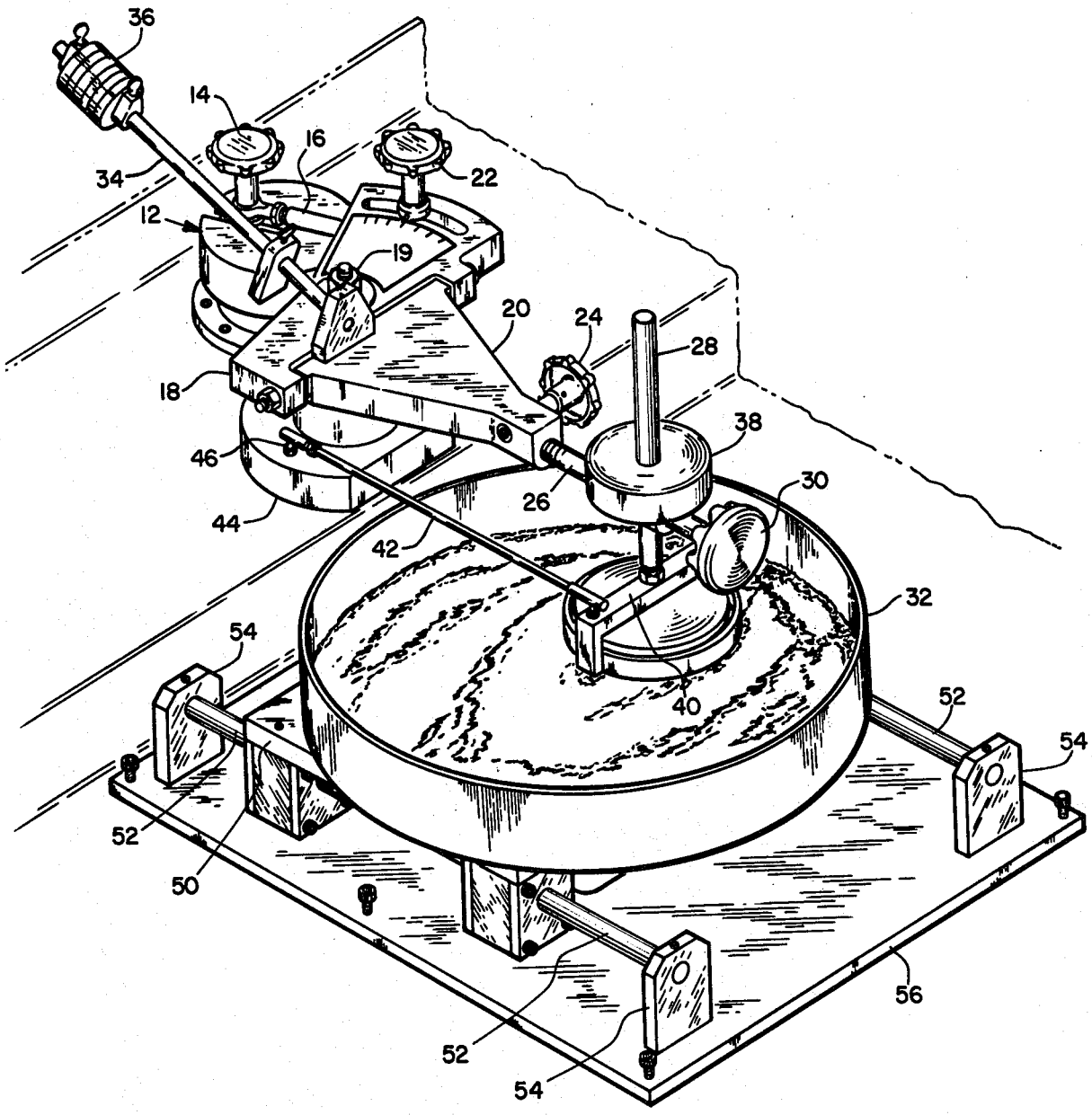
FIG. 1 shows a complete embodiment of a toroidal polisher.

FIG. 1 shows the present invention in operation. The present invention can be used in either polish or grind a lens or mirror. Polishing or grinding can be considered interchangable in the description that follows. Similarly the term lens and mirror can be used interchangably. By means of a motor not shown, wheel 12 rotates. Handle 14 is mounted on wheel 12 and can be adjusted for various lengths of stroke. Handle 14 in turn drives rod 16 which is attached to block 18. Block 18 is mounted on pivot 19 and pivots as it is driven by rod 16. Yoke 20 is attached to block 18 and moves from side to side as block 18 pivots. Adjustment setting 22 allows the stroke to be centered. This type of spindle movement and control is available in conventional optical machines.

Arm 26 is set at various lengths of extension from yoke 20 by locking screw 24. In practice, the variation of arm 26 is used to center the lens and lap for the radius desired along one axis. Spindle 28 is attached to arm 26 by locking screw 30 which permits variable height adjustments. Spindle 28 moves back and forth in an arc whose radius is equal to the distance from the pivot point of block 18 to spindle 28. For a large radius of curvature, any short portion of the arc approximates a straight line. The larger the radius, the closer the approximation becomes. Thus, it can be seen that the length of yoke 20 can control how close an approximation is required.

Yoke 20 has been modified by the addition of counter-balance arm 34. Weights 36 can be placed as needed to offset the weight of yoke 20 and arm 26. The amount of force pressing spindle 28 down is then known to be exactly proportional to mass 38 placed on spindle 28.

Spindle 28 has either a lens or a lap attached to its lower end. In FIG. 1, a gimbal assembly 40 is attached. Gimbal assembly 40 permits the lens or lap to pivot around the axes desired. Stablizer rod 42 is attached to gimbal assembly 40 and anchored to non-moving mounting 44. Stabilizer rod 42 is attached to pivot 46 on mounting 44 so it can swing with gimbal assembly 40. As gimbal assembly 40 swings back and forth, stabilizer rod 42 prevents it from twisting.

Bowl 32 rests on carriage 50 which moves with reciprocating rectilinear motion over rods 52. Rods 52 are aligned perpendicular to the back and forth motion of gimbal assembly 40. Rods 52 are supported by mountings 54 attached to base plate 56.

The bowl feed system shown in FIG. 1 is the preferred system of polishing a lens as opposed to fresh feed. Fresh feed uses an operator standing by to squirt the lens and lap as required. The bowl feed method uses a pan which contains a slurry which constantly bathes the lens and lap. In addition, the same polishing particles are reused and such reuse wears them smaller, permitting finer polishing as time goes by.

Figure 2:
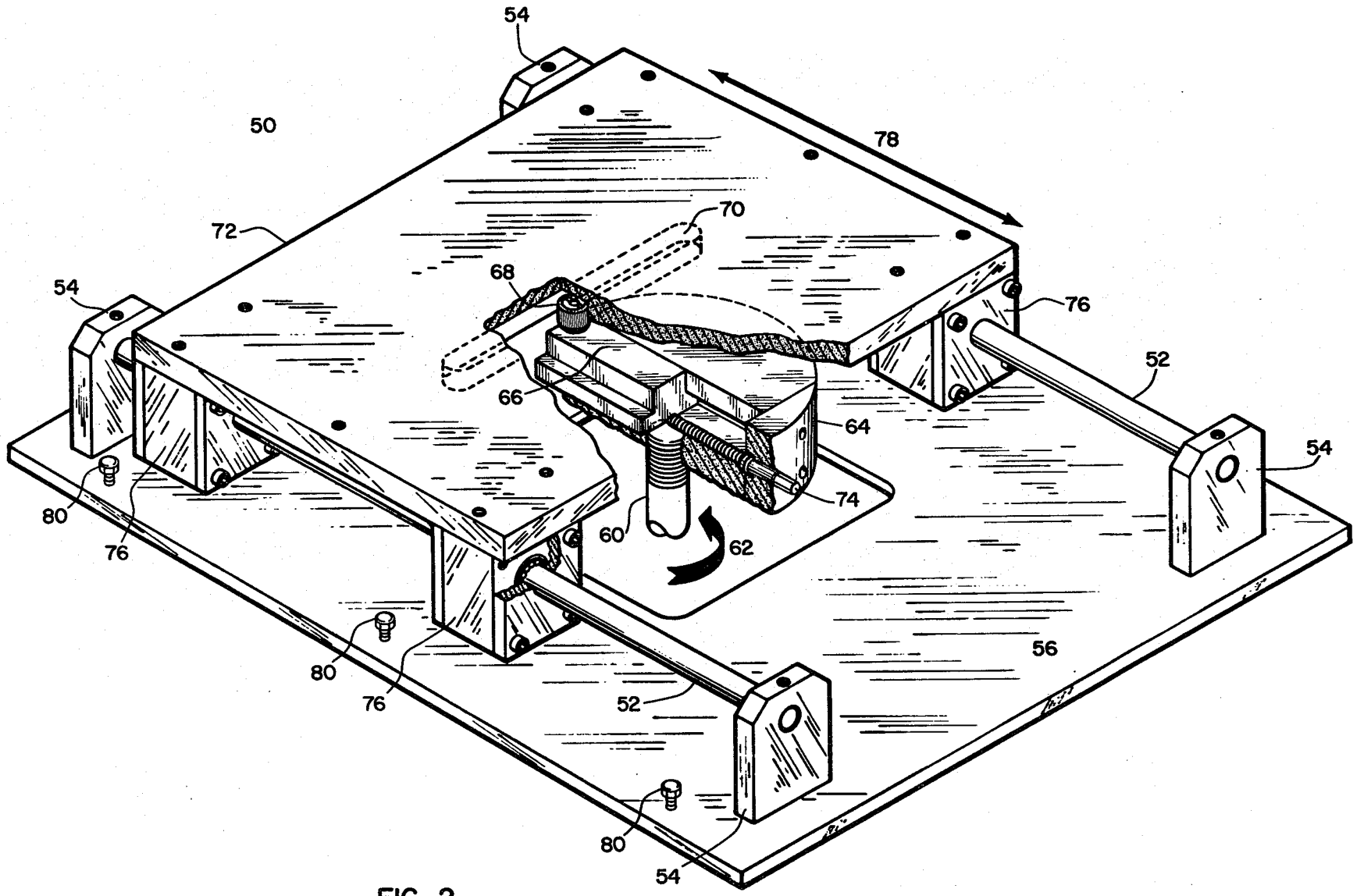
FIG. 2 shows an adapter unit with the center section cut away.

FIG. 2 shows a cut away view of how carriage 50 functions. Rotating spindle 60 turns as shown by arrow 62. Rotating spindle 60 is turned by a motor which is not shown. This motor does not have to be the same motor driving wheel 12 in FIG. 1. These can be conventional motors that can be adjusted to a wide range of speeds. Mounted on rotating spindle 60 is cam drive block 64. Cam drive block 64 has a T-shaped top which contains a T-block T 66. T-block T 66 holds cam follower bearing 68 which fits into slot 70 on the bottom of working surface 72. Adjustment screw 74 permits continuously variable adjustment of the radius of cam follower bearing 68 from rotating spindle 60. This controls the length of stroke over rods 52. This carriage thus functions as a type of cylindrical cam.

Working surface 72 is mounted on four linear bearings 76 as shown. Working surface 72 is large enough to support a bowl feed system as shown in FIG. 1. Linear bearings 76 provide low friction reciprocating rectilinear motion over rods 52 as shown by arrow 78. Rods 52 are supported by mountings 54 on apertured base plate 56 as discussed previously.

Cam follower 68 slides back and forth in slot 70 as cam drive block 64 rotates. This keeps the lateral component of rotating spindle 60 motion from moving working surface 72. The perpendicular component in the working surface plane of motion from rotating spindle 60 is used to drive working surface 72 over rods 52. Slot 70 can have a replaceable liner, such as a steel liner, not shown, inserted in slot 70 to avoid having bearing 68 wear away the sides of slot 70.

Rotating spindle 60 is placed so that is protrudes through the central area of base plate 56. To allow this, the central area of base plate 56 is cut away as shown in FIG. 2.

Regular lens polishers have an upper spindle that moves laterally as shown in FIG. 1 and a rotating lower spindle as shown in FIG. 2. Thus, carriage 50 shown in FIG. 2 is a unit that will adapt conventional lens polishing machines into toroidal polishing machines Conversely a toroidal machine built as disclosed here can be easily converted to a conventional optical machine if base plate 56 and cam drive block 64 are designed to be easily removed. FIG. 2 shows one way of accomplishing this. Cam drive block 64 screws onto lower rotating spindle 60 and base plate 56 is held in place by screws 80.

Figure 3:
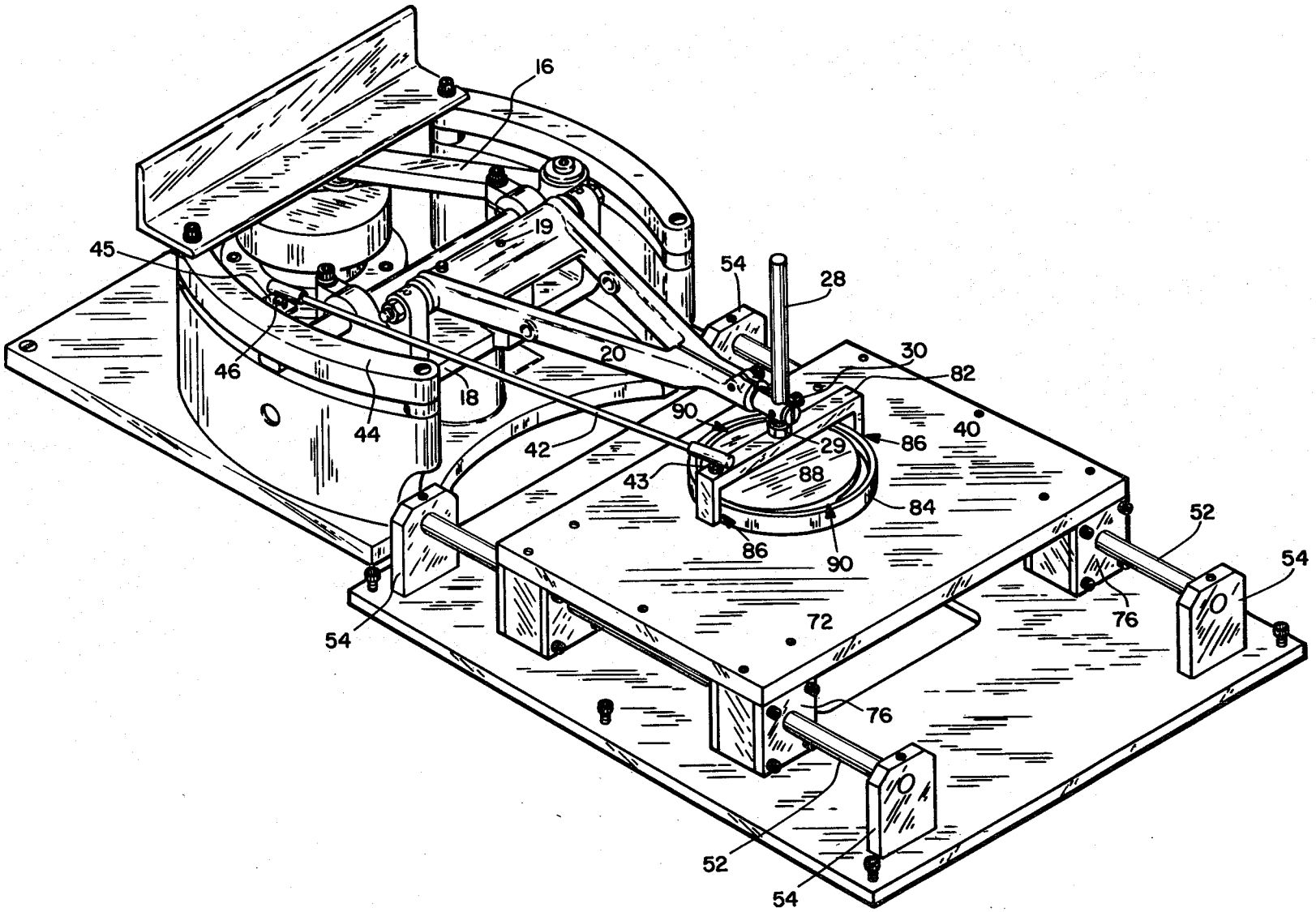
FIG. 3 shows the gimbal assembly and stablizing bar.

FIG. 3 shows gimbal assembly 40. As before, it is attached to upper spindle 28 and similar parts are noted by numbers previously explained. Stabilizer rod 42 is shown anchored in a slightly different manner than in FIG. 1. Extension 45 is attached to mounting 44. Stabilizer rod 42 is pivoted by pivot 46 on extension 45. There are two important aspects of stabilizer rod 42 that should be noted. The first is that pivot 46 is the same distance from pivot 19 as the distance between point 29, which is where spindle 28 ends, and point 43, which is where stablizer rod 42 is attached to gimbal assembly 40. The second is that the length of stablizer rod 42 is identical to the distance from pivot 19 to point 29. This arrangement is a parallel pantograph. A parallelogram is formed by the sides described.

If a high radius of curvature is to be polished, spindle 28 will ride up and down vertically. This changes the effective length of yoke 20. The result could be a changing angle between the lap and the lens. Such a problem can be prevented by creating another parallel pantograph. Point 29 in FIG. 3 should be pivoted and another stabilizer bar, not shown, would be used. This one would be attached to spindle 28 and mounted above pivot 19. The distances would form a parallelogram as described before.

Gimbal assembly 40 consists of crossbar 82 which is attached to spindle 28 and stablizer rod 42. Ring 84 is pivoted at points 86 which are aligned parallel to the motion of spindle 28. Holding plate 88 is pivoted within ring 84 at points 90. Points 90 are aligned parallel to the motion of working surface 72.

Either the lens to be polished, also called a work piece, or the lap is anchored in the bottom of bowl 32. Holding plate 88 then holds either the lens if the lap is mounted in bowl 32 or the lap if the lens is mounted in bowl 32. There are two different grinding or polishing motions over axes 90° to one another. Thus, the lens is polished to two different radii which are at 90° to one another.

It has been found that the orientation of the axes on the lens are rotated a different amount for each individual combination of radii. This is corrected empirically by running a sample to measure the amount of rotation and then rotating the gimbal assembly by the amount measured.

What is claimed is:

1. A toroidal polisher using a workpiece and a lap comprising:
   - a motor;
   - a spindle attached to and rotated by said motor;
   - a cylindrical cam drive mounted on said spindle for converting said spindles rotary motion into reciprocating rectilinear motion;
   - a base plate lacking a central area so that said base plate can be placed such that said cylindrical cam drive protrudes through said central area;
   - a plurality of rods attached to said base plate for guiding said reciprocating rectilinear motion;
   - a plurality of linear bearings mounted on said rods for providing low friction motion over said rods;
   - a work surface with a slot in one side which has said slot fitted over said cylindrical cam drive and is connected to said linear bearings such that said surface is driven with reciprocating rectilinear motion over said rods by said cam follower bearing;
   - means fastened to said cylindrical cam drive for variably controlling the range of rectilinear motion produced;
   - means fastened to said work surface so as to be driven with said work surface by said reciprocating rectilinear motion of said work surface for supporting objects which move with said work surface;
   - means for attaching either said workpiece or said lap to said support means;
   - means for holding the other of said lap or said workpiece against the one held by said attaching means; and
   - means attached to said holding means for driving said holding means back and forth in a direction perpendicular to the linear motion of said work surface, the amount of back and forth perpendicular motion independent of said back and forth linear motion.

2. A toroidal polisher as described in claim 1 where said cylindrical cam drive comprises:
   - a cam drive block with top and bottom surfaces mounted on said spindle on its bottom surface for providing a support base;
   - a cam follower bearing mounted on said top surface of said cam drive block and fitted to said carriage for driving said carriage; and
   - a T-block mounted in said top surface of said cam drive block and attached to said cam follower bearing so as to be adjustable so that said cam follower bearing drives said carriage with variable ranges of reciprocating rectilinear motion.

3. A toroidal polisher as described in claim 1 where said variable control means is a continuously adjustable screw.

4. A toroidal polisher as described in claim 1 where a liner is inserted in said slot to reduce wear from said cam follower bearing.

5. A toroidal polisher as described in claim 1 where said support means is a bowl feed system.

6. A toroidal polisher as described in claim 1 where said holding means is a gimbal assembly.

7. A toroidal polisher as described in claim 6 where said gimbal assembly is attached to an anchored stabilizer rod so as to form a parallel pantograph which keeps said gimbal assembly from twisting as it moves back and forth.

8. A toroidal polisher as described in claim 1 where said driving means comprises:

a motor producing rotational motion; and means attached to said motor for converting said rotational motion into back and forth lateral motion such that said lateral motion is perpendicular to said reciprocating rectilinear motion.

9. A toroidal polisher as described in claim 8 where said converting means is a movement arm of variable length so that the resultant arc of said movement arm is as close to an infinite radius as required.

10. A toroidal polisher as described in claim 9 where said movement arm has a counter-balance arm attached to it so that the force pressing the lens and lap together can be accuratly determined.

11. A toroidal polishing adapting unit for a conventional polishing machine with a rotating spindle and an upper spindle driven laterally back and forth comprising:

an apertured base plate which is capable of having said lower spindle protrude through said aperture;

a plurality of rods mounted on said base plate for providing a track perpendicular to the lateral motion of said upper spindle;

a plurality of linear bearings mounted on said rods for providing low friction movement over said rods;

a working surface with a slotted bottom mounted on said linear bearings such that said slotted bottom passes over said central area; and a cylindrical cam drive mechanism fitted into said slotted bottom so that said working surface is given reciprocating rectilinear motion on said track, said cylindrical cam drive mechanism adapted so it can be driven by a rotating spindle.

12. A toroidal polishing adapter unit as described in claim 11 where said slotted bottom has a liner inserted in it to reduce wear.

13. A toroidal polishing adapter unit as described in claim 12 where said liner is replaceable so that the useful life of said working surface is extended.

14. A toroidal polishing adapter unit as described in claim 11 where said upper spindle supports a gimbal assembly.

15. A toroidal polishing adapter unit as described in claim 14 where said gimbal assembly is attached to a stablizer rod so as to form a parallel pantograph to prevent twisting of said gimbal assembly as it is driven back and forth by said upper spindle.

16. A toroidal polishing adapter unit as described in claim 11 where said cylindrical cam drive contains an adjustment screw permitting a continuously variable range of said reciprocating rectilinear motion.

17. A toroidal polishing adapter unit as described in claim 11 where said working surface is capable of supporting a bowl feed system.

18. A toroidal polishing adapter unit as described in claim 11 where said upper spindle is counter balanced to permit the force pressing the lens and lap together to be accurately determined.

* * * * *